US011456542B2

(12) United States Patent
Liu et al.

(10) Patent No.: US 11,456,542 B2
(45) Date of Patent: Sep. 27, 2022

(54) RADIATING ELEMENT FOR MULTI-BAND ANTENNA AND MULTI-BAND ANTENNA

(71) Applicant: CommScope Technologies LLC, Hickory, NC (US)

(72) Inventors: Jian Liu, Suzhou (CN); HongHui Chen, Suzhou (CN); Yuemin Li, Suzhou (CN)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 61 days.

(21) Appl. No.: 17/268,553

(22) PCT Filed: Aug. 8, 2019

(86) PCT No.: PCT/US2019/045612
§ 371 (c)(1),
(2) Date: Feb. 15, 2021

(87) PCT Pub. No.: WO2020/046551
PCT Pub. Date: Mar. 5, 2020

(65) Prior Publication Data

US 2021/0320433 A1 Oct. 14, 2021

(30) Foreign Application Priority Data

Aug. 28, 2018 (CN) ..... 201810983849.3

(51) Int. Cl.
*H01Q 5/28* (2015.01)
*H01Q 21/26* (2006.01)
(Continued)

(52) U.S. Cl.
CPC ..... *H01Q 21/26* (2013.01); *H01Q 1/36* (2013.01); *H01Q 5/28* (2015.01); *H01Q 5/48* (2015.01); *H01Q 21/064* (2013.01)

(58) Field of Classification Search
CPC ..... H01Q 1/36; H01Q 19/108; H01Q 1/246; H01Q 21/24; H01Q 21/062; H01Q 1/523;
(Continued)

(56) References Cited

U.S. PATENT DOCUMENTS 5,821,902 A 10/1998 Keen
9,912,076 B2 * 3/2018 Bisiules ..... H01Q 1/38
(Continued)

FOREIGN PATENT DOCUMENTS

CN 208904208 U 5/2019
EP 3614491 A1 2/2020
WO 2014100938 A1 7/2014

OTHER PUBLICATIONS

"Communication pursuant to Article 94(3) EPC", EP Application No. 19194014.7, Oct. 9, 2020, 7 pp.
(Continued)

*Primary Examiner* — Vibol Tan
(74) *Attorney, Agent, or Firm* — Myers Bigel, P.A.

(57) ABSTRACT

A first band radiating element for a multi-band antenna comprises at least one first band dipole that has a first dipole arm and a second dipole arm that each include one or more arm segments, and the number of the arm segments of the first dipole arm is greater than the number of the arm segments of the second dipole arm.

20 Claims, 9 Drawing Sheets

(51) Int. Cl.
*H01Q 5/48* (2015.01)
*H01Q 1/36* (2006.01)
*H01Q 21/06* (2006.01)

(58) Field of Classification Search
CPC ..... H01Q 5/321; H01Q 5/42; H01Q 21/30; H01Q 1/242; H01Q 9/26; H01Q 21/26; H01Q 1/362; H01Q 9/285; H01Q 21/28; H01Q 9/16; H01Q 1/38; H01Q 1/521; H01Q 9/0421; H01Q 1/24; H01Q 13/08; H01Q 23/00; H01Q 1/2233; H01Q 5/00; H01Q 1/243
See application file for complete search history.

(56) References Cited

U.S. PATENT DOCUMENTS 10,439,285 B2 * 10/2019 Isik ..... H01Q 21/26
11,018,437 B2 * 5/2021 Tang ..... H01Q 21/26
11,271,327 B2 * 3/2022 Shan ..... H01Q 1/521
2015/0084823 A1 3/2015 Wang et al.
2015/0364832 A1 12/2015 Karlsson et al.
2017/0294715 A1 10/2017 Wu et al.

OTHER PUBLICATIONS

"Communication with European Search Report", EP Application No. 19194014.7, dated Nov. 4, 2019, 9 pp.
"International Search Report and Written Opinion of the International Searching Authority", International Application No. PCT/US2019/045612, dated Nov. 19, 2019, 9 pp.
Ta, Son Xuat , et al., "Multi-Band, Wide-Beam, Circularly Polarized, Crossed, Asymmetrically Barbed Dipole Antennas for GPS Applications", IEEE Transactions on Antennas and Propagation, vol. 61, No. 11, Nov. 2013, 5771-5775.

* cited by examiner

RADIATING ELEMENT FOR MULTI-BAND ANTENNA AND MULTI-BAND ANTENNA

CROSS-REFERENCE TO RELATED APPLICATIONS

The present application is a 35 U.S.C. § 371 national stage application of PCT Application No. PCT/US2019/045612, filed Aug. 8, 2019, which itself claims priority to Chinese Patent Application No. 201810983849.3, filed Aug. 28, 2018, the entire contents of both of which are incorporated herein by reference in their entireties. The above-referenced PCT Application was published in the English language as International Publication No. WO 2020/046551 A1 on Mar. 5, 2020.

FIELD OF THE INVENTION

The present invention generally relates to multi-band antennas and, more specifically, to multi-band antennas with asymmetric radiating elements.

BACKGROUND

In multi-band antennas, radiating elements of different frequency bands may interfere with each other. For example, a low-band radiating element may generate interfering signals that fall within the operating frequency band of a high-band radiating element, thereby affecting the performance, such as the beam width and the like, of the high-band radiating element. In the prior art, such interfering signals may, for example, be suppressed by an arrangement of chokes on the low-band radiating element. However, the chokes may deteriorate the return loss performance of the low-band radiating element.

SUMMARY

According to a first aspect of the present invention, there is provided a first band radiating element comprising at least one first band dipole, where the first band dipole has a first dipole arm and a second dipole arm, and each of the dipole arms includes one or more arm segments, and the number of the arm segments of the first dipole arm is greater than the number of the arm segments of the second dipole arm.

In some embodiments, the number of the arm segments of the first dipole arm and the second dipole arm may be adapted based on the requirements in the aspects of "transparency performance" (i.e., the interference or scattering of the first band radiating element itself to the radiating elements of other bands, where the lower the interference or scattering, the better the "transparency performance") and in terms of return loss performance. For example, for optimizing the transparency performance, the number of the arm segments of dipole arms, in particular the number of the arm segments of the first dipole arm, may be increased. In contrast, for optimizing the return loss performance, the number of the arm segments of dipole arms, in particular the number of the arm segments of the second dipole arm, may be reduced.

In some embodiments, the multi-band antenna further includes a second band radiating element.

In some embodiments, the first band radiating element may be a low-band radiating element, for example covering the 617 MHz to 960 MHz frequency band or a portion thereof. The second band radiating element may be a high-band radiating element, for example covering the 1695 MHz to 2690 MHz frequency band or a portion thereof. The multi-band antenna may also include radiating elements that operate in other frequency bands.

In some embodiments, the second dipole arm is spaced farther from the second band radiating element than the first dipole arm.

In some embodiments, the second band radiating element is disposed in the vicinity of regions underneath the first dipole arm and remote from regions underneath the second dipole arm.

Since the number of the arm segments of the first dipole arm is greater than the number of the arm segments of the second dipole arm, arranging the first dipole arm near the second band radiating element may realize improved "transparency performance for the first band radiating element. Furthermore, as the second dipole arm is remote from the second band radiating element and has fewer arm segments, the return loss performance of the first band radiating element may also be improved.

In some embodiments, the first dipole arm is arranged opposite the second dipole arm at an angle of 180 degrees.

In some embodiments, the first dipole arm and the second dipole arm each includes a central conductor and a plurality of arm segments arranged around the central conductor, where the plurality of arm segments are spaced apart from each other along the central conductor.

In some embodiments, the arm segment includes a hollow electrical conductor, wherein the hollow electrical conductor is connected at one end to the central conductor and disconnected at the other end from the central conductor, thereby forming a so-called "choke", that is, a gap between the hollow electrical conductor and the central conductor and a gap between the individual hollow electrical conductors. As a result, the interfering signals generated by the first band radiating element, that fall within the operating band range of the other band radiating element, such as the second band radiating element, are suppressed. The length of each arm segment may be adapted according to the operating frequency band of the radiating elements of the other band, such as the second band radiating element.

In some embodiments, the central conductor has a plurality of protrusions disposed axially on the central conductor from one end of the central conductor and spaced apart from each other, thereby dividing the central conductor into a plurality of electrically conducting segments, said hollow electrical conductor and said central conductor being connected on said protrusions.

In some embodiments, the hollow electrical conductor and the central conductor may be made of aluminum. During manufacturing, the hollow electrical conductor may be pressed onto the protrusion of the central conductor to form an electrical connection. The hollow electrical conductor and/or the central conductor may also be made of other suitable metals.

In some embodiments, at least two protrusions in the second dipole arm that are spaced apart from each other are connected by the hollow electrical conductor. As a result, at least two originally spaced-apart arm segments become one arm segment, thereby reducing at least one gap between the individual hollow electrical conductors and thus reducing the return loss.

In some embodiments, at least two adjacent protrusions in the second dipole arm are connected by the hollow electrical conductor.

In some embodiments, the hollow electrical conductor which connects the at least two spaced apart protrusions, is disposed in an end region or a middle region of the second dipole arm.

In some embodiments, there is no electrically conducting segment between the at least two spaced apart protrusions. That is, the electrically conducting segment between the at least two adjacent protrusions is removed. This can significantly reduce the manufacturing cost of the radiating element without reducing the reliability of the radiating element.

In some embodiments, the hollow electrical conductor is configured as a hollow cylindrical structure.

In some embodiments, gaps are present between the hollow electrical conductor and the central conductor. In some embodiments, the gaps may be filled with air, or the gaps may be completely or partly filled with dielectric material.

In some embodiments, the first dipole arm and the second dipole arm are constructed on a printed circuit board ("PCB").

In some embodiments, the first band radiating element is a low-band radiating element and the second band radiating element is a high-band radiating element.

In some embodiments, the first dipole arm and the second dipole arm each have a plurality of arm segments that are spaced apart from each other, and the plurality of arm segments are connected via a filter mechanism.

In some embodiments, the filter mechanism comprises an inductive element or a combination of the inductive element and a capacitive element.

In some embodiments, the filter mechanism exhibits a high impedance characteristic in the second band and a low impedance characteristic in the first band.

According to a second aspect of the present invention, there is provided a multi-band antenna comprising the first band radiating element and the second band radiating element according to the present invention, where the first band is different from the second band.

DETAILED DESCRIPTION

Figure 1A:
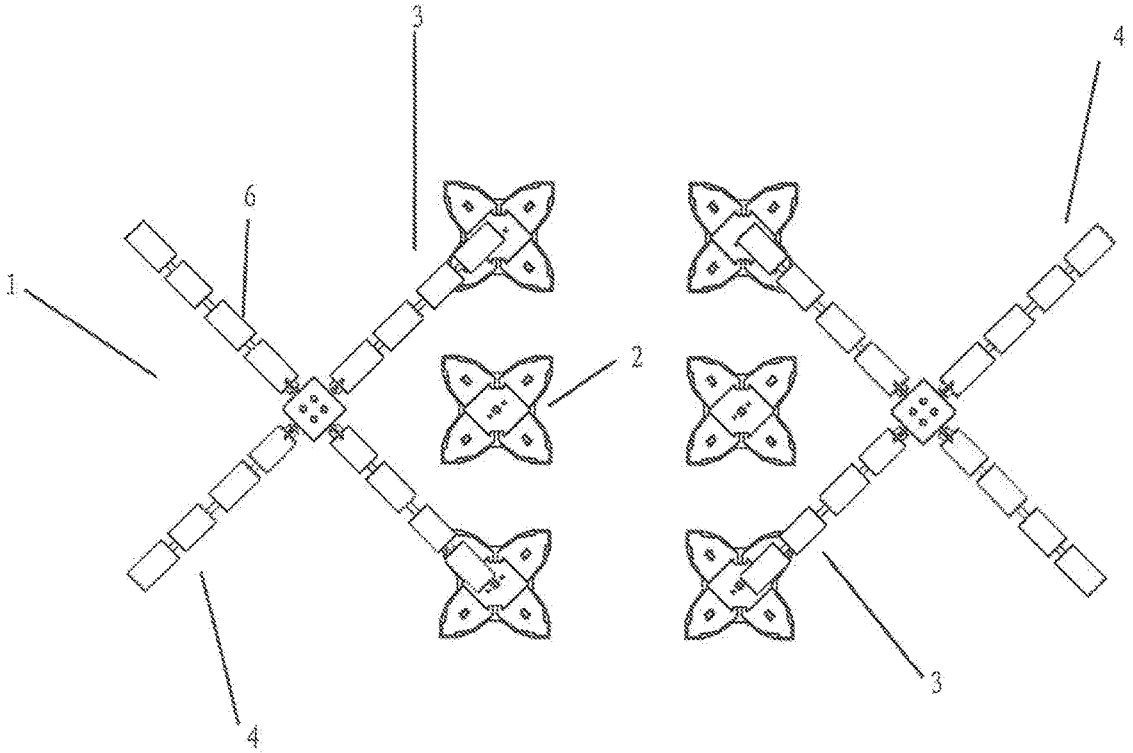
FIG. 1A (Prior Art)
FIG. 1A is a partial top view of a prior art multi-band antenna.

The present invention will be described below with reference to the drawings, in which several embodiments of the present invention are shown. It should be understood, however, that the present invention may be implemented in many different ways, and is not limited to the example embodiments described below. The embodiments described hereinafter are intended to make a more complete disclosure of the present invention and to adequately explain the protection scope of the present invention to a person skilled in the art. It should also be understood that, the embodiments disclosed herein can be combined in various ways to provide many additional embodiments. For the sake of conciseness and/or clarity, well-known functions or constructions may not be described in detail.

The singular forms "a/an", "said" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the relevant items listed.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

It should be understood that, in all the drawings, the same reference signs present the same elements. In the drawings, for the sake of clarity, the sizes of certain features may not always be drawn to scale.

A first band radiating element of the present invention is applicable to various types of multi-band antennas, and is particularly suitable for multi-band antennas with interspersed radiating elements (for example, ultra-wideband dual-band dual-polarization antennas). The term "dual band antenna" refers herein to an antenna that has two different types of radiating elements that are designed to operate in two different frequency bands, which are typically referred to as the "low band" and the "high band." For example, a common dual band antenna design includes one or more arrays of low band radiating elements that operate in the 617 MHz to 960 MHz frequency band, or one or more portions thereof, and one or more arrays of "high band" radiating elements that operate in the 1695 MHz to 2690 MHz" frequency band, or one or more portions thereof. Herein, the term "multi-band antenna" refers to an antenna that has two or more different types of radiating elements that are designed to operate in different frequency bands, and encompasses both dual band antennas and antennas that support service in three or more frequency bands.

Figure 1B:
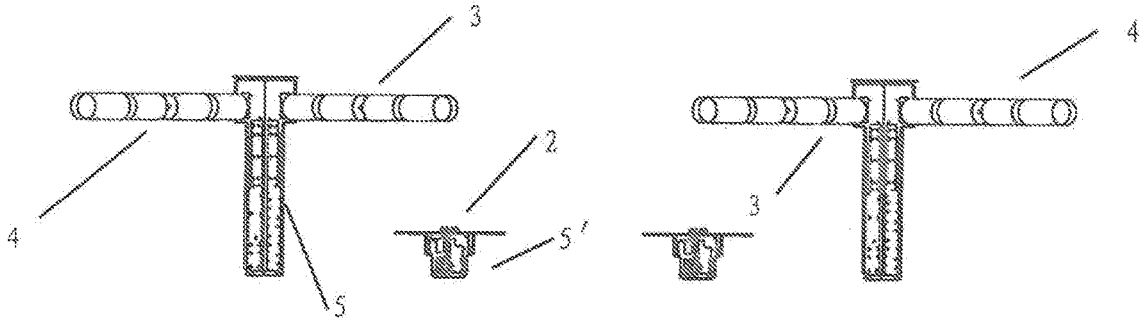
FIG. 1B (Prior Art)
FIG. 1B is a partial front view of the prior art multi-band antenna of FIG. 1A.

Referring now to FIGS. 1A and 1B, a partial top view and a partial front view of a conventional multi-band antenna are shown. The multi-band antenna may be a dual-band, dual-polarization antenna with interspersed radiating elements. As shown in FIGS. 1A and 1B, the dual-band, dual-polarization antenna with interspersed radiating elements includes low-band radiating elements 1 and high-band radiating elements 2. The low-band radiating elements 1 and the high-band radiating elements 2 are both dual-polarization radiating elements, that is, each low-band radiating element 1 has two pairs of dipole arms that form two dipoles and each high-band radiating element 2 has two pairs of dipole arms that form two dipoles. In the example of FIG. 1A, two arrays of high-band radiating elements 2 are shown, with three high-band radiating elements 2 in each array. Outside each array is illustrated one low-band radiating element 1. In other examples, it may be envisaged that more than two or less than two arrays of high-band radiating elements 2 are provided, with more than three or less than three high-band radiating elements 2 in each array, and that more than one low-band radiating element 1 is provided outside each array of the high-band radiating elements 2. As can be seen from FIG. 1B, the low-band radiating elements 1 and the high-band radiating elements 2 have feed stalks 5, 5' respectively. The feed stalk 5 of the low-band radiating element 1 is higher than the feed stalk 5' of the high-band radiating element 2.

As can be seen from FIGS. 1A and 1B, each low-band radiating element 1 has a first dipole arm 3 and a second dipole arm 4 that together form a first dipole. The first dipole arm 3 is arranged opposite the second dipole arm 4 at an angle of 180 degrees so that the first and second dipole arms 3, 4 are collinear. The first dipole arm 3 is positioned close to one or more of the high-band radiating elements 2, whereas the second dipole arm 4 is spaced farther apart from the high-band radiating elements 2. In other words, one or more of the high-band radiating elements 2 may be disposed in the vicinity of regions underneath the first dipole arm 3 and may be remote from regions underneath the second dipole arm 4. In the example as is shown, the first dipole arm 3 and the second dipole arm 4 each have four arm segments 6 that are spaced apart from each other in the axial direction of each dipole arm and have substantially the same length. The arrangement in which the first dipole arm 3 and the second dipole arm 4 have the same number of arm segments is referred to as "symmetric dipoles". In other examples, the first dipole arm 3 and the second dipole arm 4 may have the same number of arm segments 6 where the actual number of arm segments 6 is more than or less than four arm segments 6.

A principal challenge in the design of multi-band antennas with interspersed radiating elements is reducing the scattering-interference of radiating elements at one band to the radiating elements of the other band, as the scattering affects the beam forming performance of the antenna. In a dual-band, dual-polarization antenna with interspersed radiating elements, in order to reduce the scattering-interference of the low-band radiating elements on the high-band radiating elements, it may be advantageous to introduce a plurality of spaced-apart arm segments in the dipole arms of the low-band radiating elements that act as radio frequency chokes, because the introduction of one or more chokes that are resonant at or near the high band can effectively reduce the scattering-interference of the low-band radiating elements on the high-band radiating elements.

Figure 2:
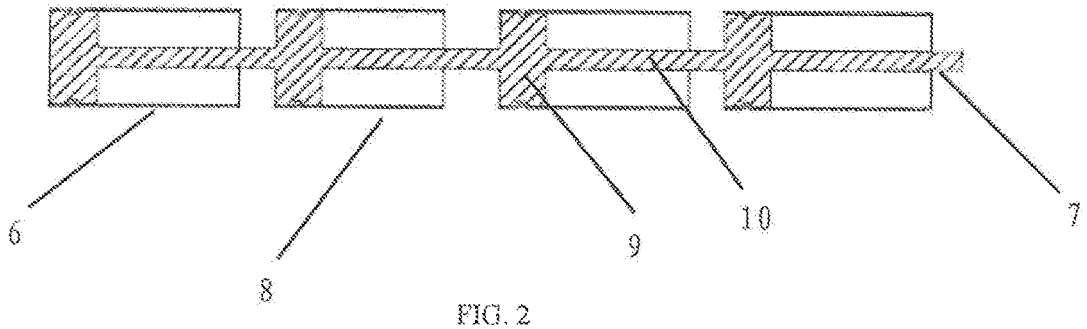
FIG. 2 (Prior Art)
FIG. 2 is a schematic structural view of the dipole arm of the prior art multi-band antenna of FIGS. 1A-1B.

FIG. 2 is a schematic view illustrating a first dipole arm 3 constructed in accordance with the principles described above. The second dipole arm 4 may have the same design. As shown in FIG. 2, the dipole arm includes a central conductor 7 and arm segments 6 that are arranged around the central conductor 7. The central conductor 7 comprises four spaced apart protrusions 9 that are disposed axially on the central conductor 7 from one end of the central conductor 7, thereby dividing the central conductor 7 into four electrically conducting segments 10. Correspondingly, four arm segments 6 are provided, which are constructed as hollow electrical conductors having hollow tubular or cylindrical structures.

Each hollow electrical conductor is connected at one end to the electrically conducting segment 10 through a radially-extending protrusion 9 of the central conductor 7, that is, each arm segment 6 is short-circuited at one end to the central conductor 7. Each hollow electrical conductor is disconnected at the other end from the electrically conducting segment 10 of the central conductor 7, that is, the arm segment 6 is open-circuited at the other end to the central conductor 7. As a result, so-called chokes, that is, a gap between the hollow electrical conductor 8 and the central conductor 7 and a gap between the individual hollow electrical conductors 8, are formed. These gaps may typically be filled with air so that a better signal suppression effect may be realized; in other embodiments, these gaps may also be completely or partly filled with other dielectric materials.

The number and length of arm segments 6 may be adjusted according to the actual operating frequency of the high-band radiating elements 2, so as to reduce the scattering-interference of the low-band radiating elements 1 within the actual operating band range of the high-band radiating elements 2, thereby improving the transparency performance of the low-band radiating element 1 with respect to the high-band radiating element 2. However, as the number of arm segments 6 included on the dipole arm is increased, the return loss performance of the low-band radiating element 1 itself may deteriorate. The return loss, which is also referred to as reflection loss, is mainly caused by reflection due to impedance mismatch, and is measured as a ratio of the reflected wave power to the incident wave power. Since with the increase in number of the arm segments, the impedance of the dipole arm may become very large, matching the impedance of the dipole arm to the impedance of the feed stalk 5 may become increasingly difficult, resulting in degraded return loss performance.

Figure 3:
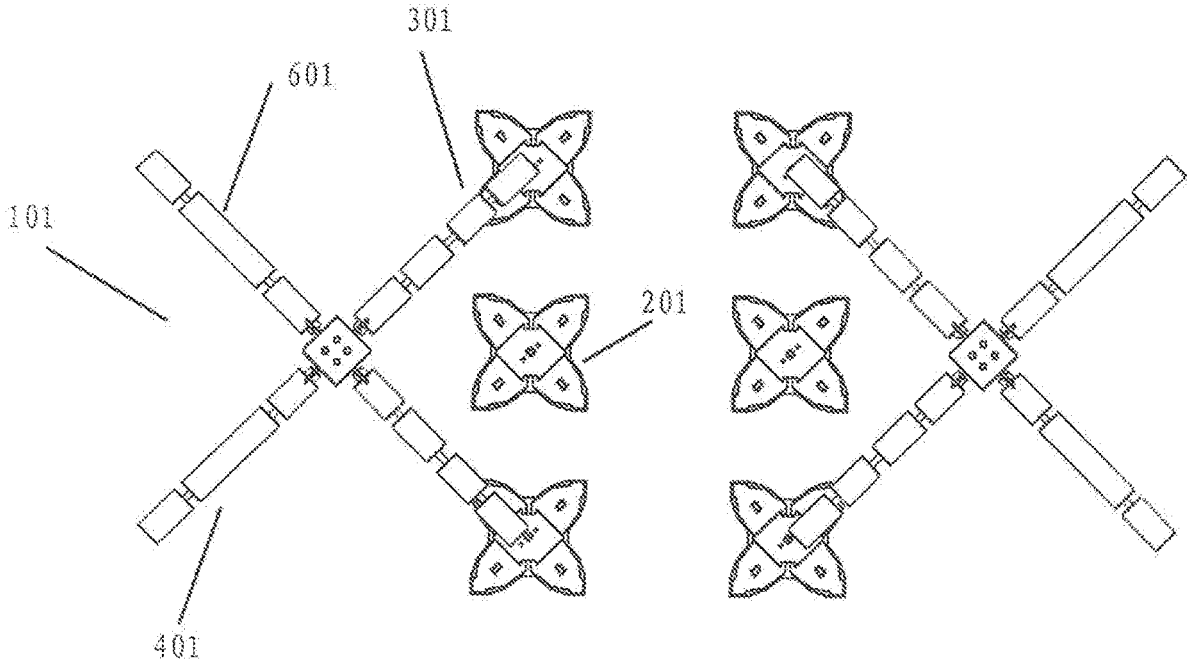
FIG. 3 is a partial top view of a multi-band antenna in accordance with a first embodiment of the present invention.

Referring now to FIG. 3, a partial top view of a multi-band antenna according to a first embodiment of the present invention is shown. Two low-band radiating elements 101 and six high-band radiating elements 201 are shown. Each low-band radiating element 101 has a first dipole arm 301 and a second dipole arm 401. The first dipole arm 301 is arranged opposite the second dipole arm 401 at an angle of 180 degrees so that the first and second dipole arms 301, 401 are collinear. The first dipole arm 301 is positioned close to the high-band radiating elements 201, whereas the second dipole arm 401 is positioned farther away from the high-band radiating elements 201. In the example shown, the first dipole arm 301 has four arm segments 601 that are spaced apart from each other and that have substantially the same length. However, the second dipole arm 401 has a smaller number of arm segments 601 in the present embodiment. In particular, the second dipole arm 401 only has three spaced apart arm segments 601, and the arm segment that is in the middle is longer than the arm segments on both sides. A dipole that has a first dipole arm 301 and a second dipole arm 401 that have different numbers of arm segments is referred to as an "asymmetric dipole." In other examples, the first dipole arm 301 may have more than four or less than four arm segments 601, and the second dipole arm 401 may have more than three or less than three arm segments 601, so long as two dipole arms have different numbers of arm segments.

Figure 4A:
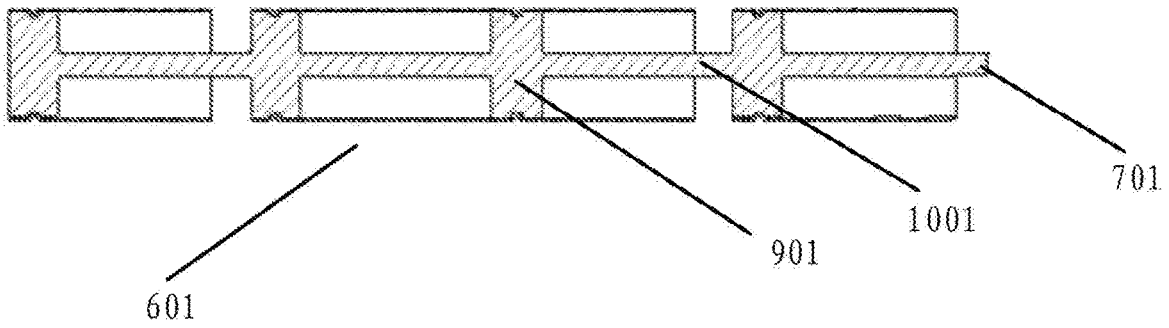
FIG. 4A is a schematic structural view of the second dipole arm in accordance with the first embodiment of the present invention.

The first dipole arm 301 has a structure similar to that of the prior art, as is shown in FIG. 2, and details will not be described herein again. Referring now to FIG. 4A, a schematic structural view of the second dipole arm 401 in the first embodiment of the present invention is shown. The second dipole arm 401 includes a central conductor 701 and arm segments 601 that are arranged around the central conductor 701. The central conductor 701 comprises four spaced-apart radially-extending protrusions 901 disposed axially on the central conductor 701 from one end of the central conductor 701, thereby dividing the central conductor 701 into four electrically conducting segments 1001.

The arm segment 601 is constructed as a hollow electrical conductor having a hollow tubular or cylindrical structure. The second dipole arm 401 has three arm segments 601, namely an intermediate arm segment, an outer arm segment (i.e. the arm segment remote from the feed end) and an inner arm segment (i.e. the arm segment close to the feed end) on both sides, in which the intermediate arm segment is longer than the outer arm segment and the inner arm segment. On the outer arm segment and the inner arm segment, the hollow electrical conductor is connected at one end to the electrically conducting segment 1001 through a protrusion 901 of the central conductor 701, and is disconnected at the other end from the electrically conducting segment 1001 of the central conductor 701, thereby forming a choke. On the intermediate arm segment, the hollow electrical conductor extends over two adjacent protrusions 901 and is connected at its one end and middle position to the two protrusions 901 respectively. The intermediate arm segment may be approximately twice the length of the outer arm segment or the inner arm segment. Since the number of the arm segments on the second dipole arm is decreased, the impedances become smaller and matching of the impedances becomes less difficult, thereby improving the return loss performance of the low-band radiating element.

Figure 4B:
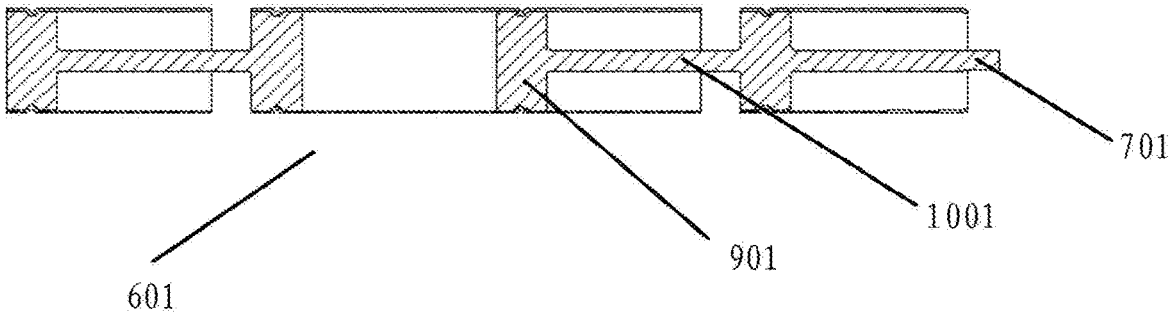
FIG. 4B is another schematic structural view of the second dipole arm in accordance with the first embodiment of the present invention.

Referring now to FIG. 4B, a schematic structural view of an alternative implementation the second dipole arm 401 in the first embodiment of the present invention is shown. The second dipole arm 401 comprises three arm segments 601, namely an intermediate arm segment, an outer arm segment and an inner arm segment, where the intermediate arm segment is between the inner and outer arm segments and longer than the inner and outer arm segments. Different from FIG. 4A, the electrically conducting segment 1001 between the two adjacent protrusions 901 in the intermediate arm segment is omitted in the embodiment of FIG. 4B, i.e., only air or other dielectric materials is provided between the two protrusions 901 included in the intermediate arm segment. This can significantly reduce the manufacturing cost of the radiating element without affecting the reliability of the radiating element.

With respect to the low-band radiating element 101 in the first embodiment, the first dipole arm 301 that is close to the array of high-band radiating elements 201 has four arm segments, while the second dipole arm 401 that is remote from the array of high-band radiating elements 201 has three arm segments. This arrangement maintains the scattering-interference of the low-band radiating element 101 on the high-band radiating element 201 at a low level, that is, the transparency performance is good, and improves the return loss performance of the low-band radiating element 101, thereby improving the performance of the dual-band antenna as a whole.

Figure 5:
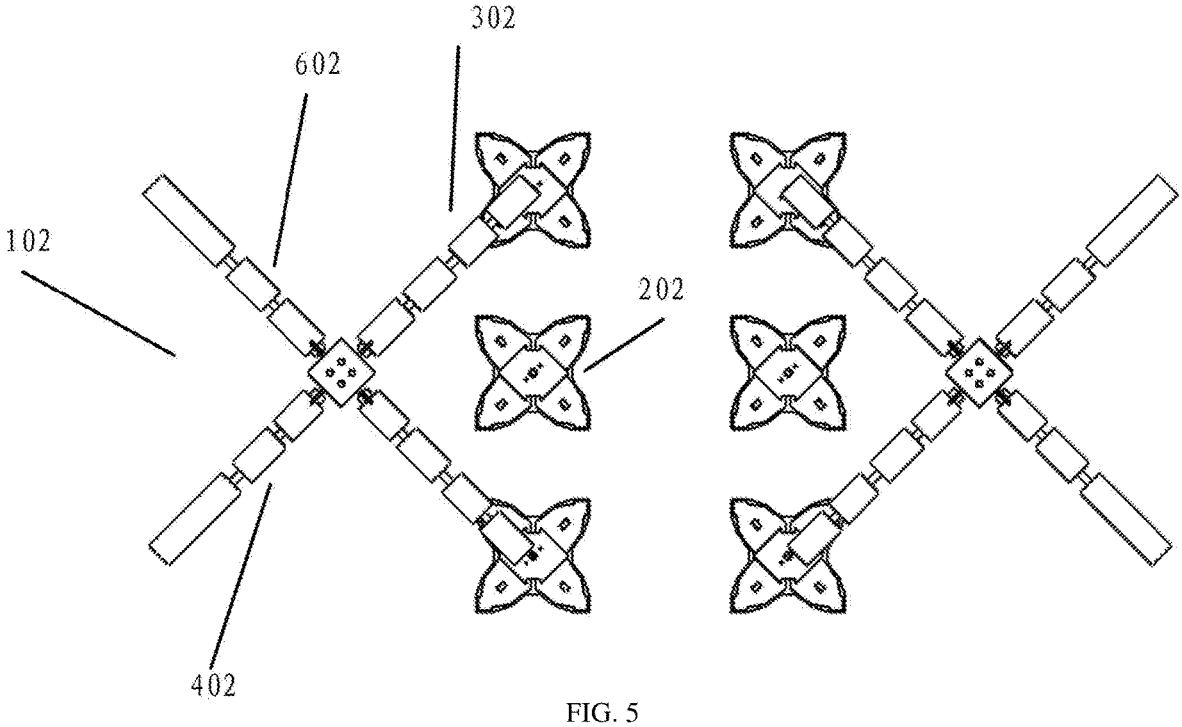
FIG. 5 is a partial top view of a multi-band antenna in accordance with a second embodiment of the present invention.

Referring now to FIG. 5, a partial top view of a multi-band antenna in accordance with a second embodiment of the present invention is shown. A low-band radiating element 102 has a first dipole arm 302 and a second dipole arm 402. The first dipole arm 302 is positioned close to the high-band radiating elements 202, whereas the second dipole arm 402 is positioned farther away from the high-band radiating elements 202. In the example as is shown, the first dipole arm 302 has four arm segments 602 that are spaced apart from each other and that have substantially the same length. The second dipole arm 402 has only three arm segments 602 that are spaced apart from each other, namely an outer arm segment, an intermediate arm segment and an inner arm segment. Unlike the first embodiment of the present invention, the intermediate arm segment and the inner arm segment have the same length, and the outer arm segment is longer than the intermediate arm segment and the inner arm segment in the second embodiment.

Figure 6:
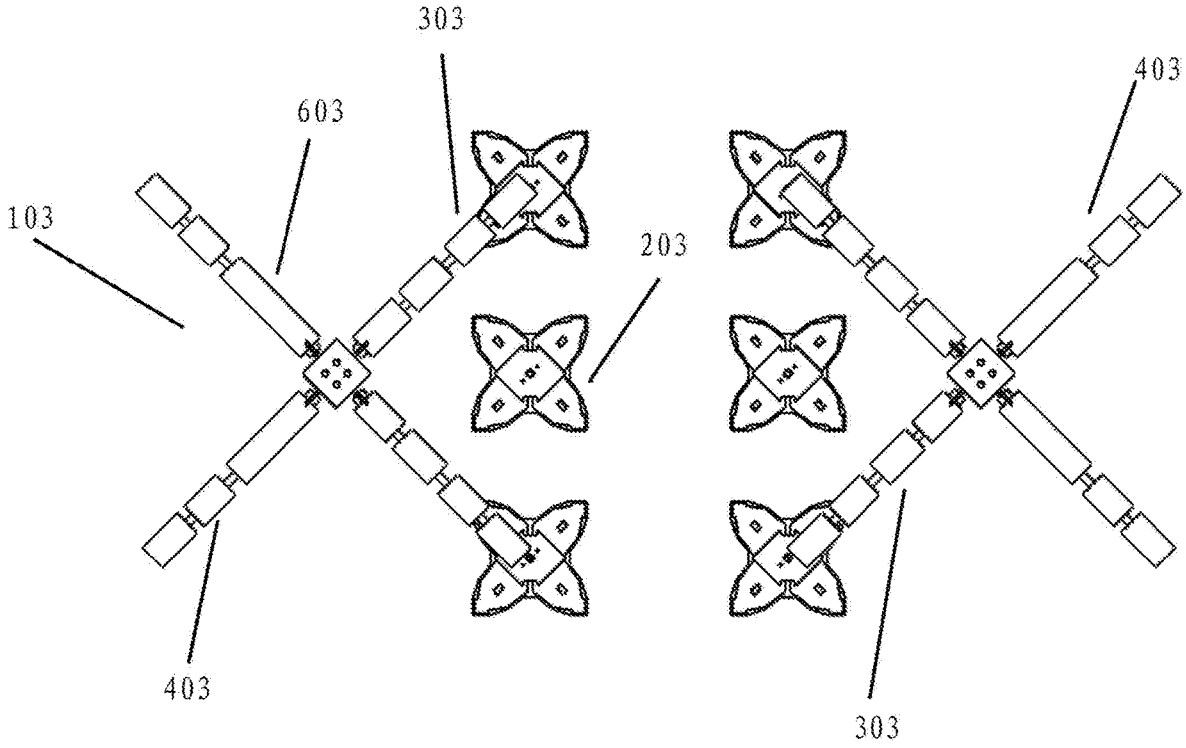
FIG. 6 is a partial top view of a multi-band antenna in accordance with a third embodiment of the present invention.

Referring now to FIG. 6, a partial top view of a multi-band antenna in accordance with a third embodiment of the present invention is shown. A low-band radiating element 103 has a first dipole arm 303 and a second dipole arm 403. The first dipole arm 303 is positioned close to the high-band radiating elements 203, whereas the second dipole arm 403 is positioned farther away from the high-band radiating elements 203. In the example as is shown, the first dipole arm 303 has four arm segments 603 that are spaced apart from each other and that have substantially the same length. The second dipole arm 403 has only three arm segments 603 that are spaced apart from each other, namely an outer arm segment, an intermediate arm segment and an inner arm segment. Unlike the first and second embodiments of the present invention, the intermediate arm segment and the outer arm segment have the same length, and the inner arm segment is longer than the intermediate arm segment and the outer arm segment in the third embodiment.

Figure 7:
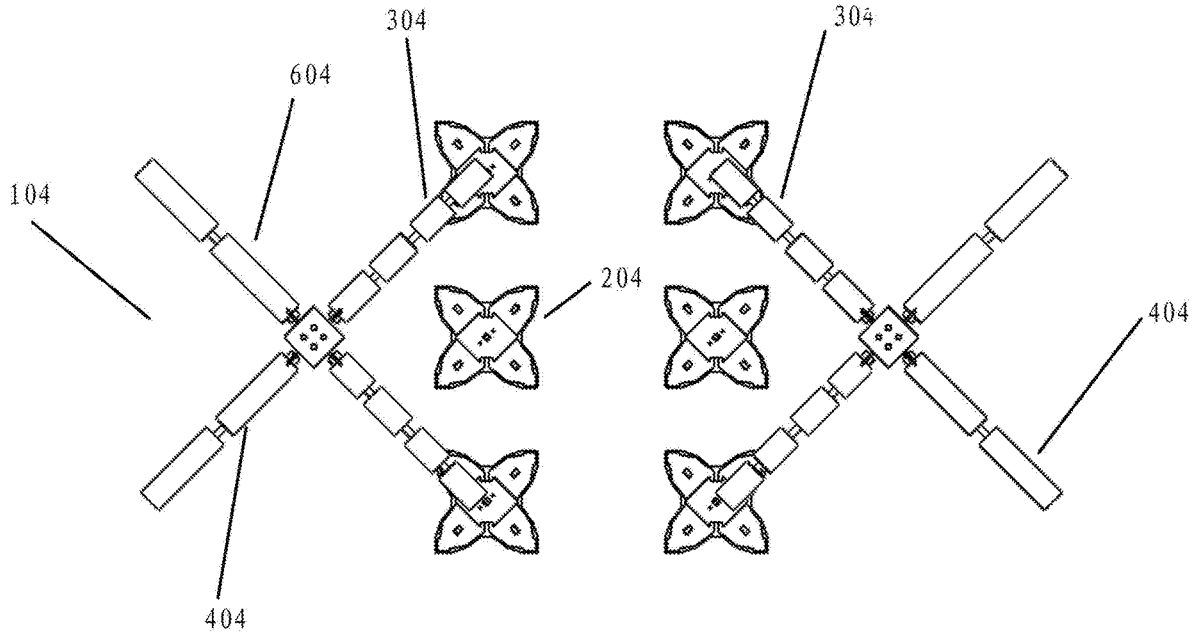
FIG. 7 is a partial top view of a multi-band antenna in accordance with a fourth embodiment of the present invention.

Referring now to FIG. 7, a partial top view of a multi-band antenna in accordance with a fourth embodiment of the present invention is shown. A low-band radiating element 104 has a first dipole arm 304 and a second dipole arm 404. The first dipole arm 304 is positioned close to the high-band radiating elements 204, whereas the second dipole arm 404 is positioned farther away from the high-band radiating elements 204. In the example as is shown, the first dipole arm 304 has four arm segments 604 that are spaced apart from each other and that have substantially the same length. Unlike the first, second and third embodiments of the present invention, the second dipole arm 404 in the fourth embodiment has only two arm segments 604 that are spaced apart from each other, namely an outer arm segment and an inner arm segment. The outer arm segment and the inner arm segment have substantially the same length. While not shown in the figures, in other embodiments, the second dipole arm 404 could have the same length as second dipole arm 404 but could have three arm segments that each have substantially the same length as opposed to two arm segments 604 as shown in FIG. 7. In such an embodiment, each arm segment for the second dipole arm 404 would be shorter than the arm segments 604 for the second dipole arm shown in FIG. 7, but longer than the arm segments 604 for the first dipole arm 304 shown in FIG. 7.

Figure 8:
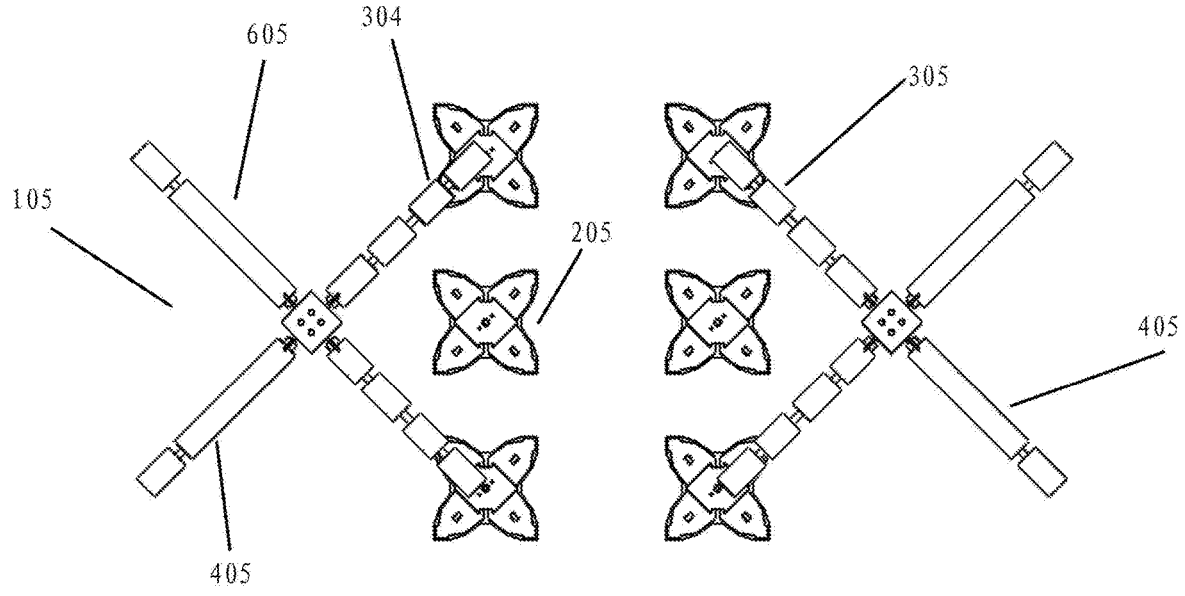
FIG. 8 is a partial top view of a multi-band antenna in accordance with a fifth embodiment of the present invention.

Referring now to FIG. 8, a partial top view of a multi-band antenna in accordance with a fifth embodiment of the present invention is shown. A low-band radiating element 105 has a first dipole arm 305 and a second dipole arm 405. The first dipole arm 305 is positioned close to the high-band radiating elements 205, whereas the second dipole arm 405 is positioned farther away from the high-band radiating elements 205. In the example as is shown, the first dipole arm 305 has four arm segments 605 that are spaced apart from each other and that have substantially the same length. The second dipole arm 405 has only two arm segments 605 that are spaced apart from each other, namely an outer arm segment and an inner arm segment. Unlike the fourth embodiment of the present invention, the inner arm segment is longer than the outer arm segment in the fifth embodiment.

Figure 9:
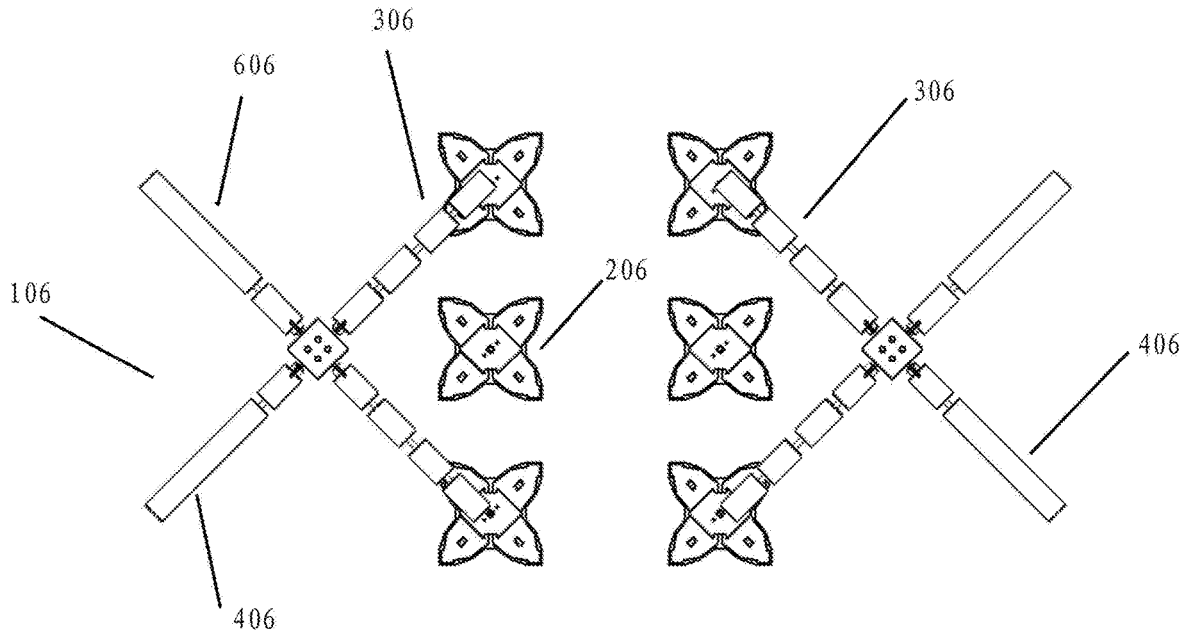
FIG. 9 is a partial top view of a multi-band antenna in accordance with a sixth embodiment of the present invention.

Referring now to FIG. 9, a partial top view of a multi-band antenna in accordance with a sixth embodiment of the present invention is shown. A low-band radiating element 106 has a first dipole arm 306 and a second dipole arm 406. The first dipole arm 306 is positioned close to the high-band radiating elements 206, whereas the second dipole arm 406 is positioned farther away from the high-band radiating elements 206. In the example as is shown, the first dipole arm 306 has four arm segments 606 that are spaced apart from each other and that have substantially the same length. The second dipole arm 406 has only two arm segments 606 that are spaced apart from each other, namely an outer arm segment and an inner arm segment. Unlike the fifth embodiment of the present invention, the outer arm segment is longer than the inner arm segment in the sixth embodiment.

Figure 10:
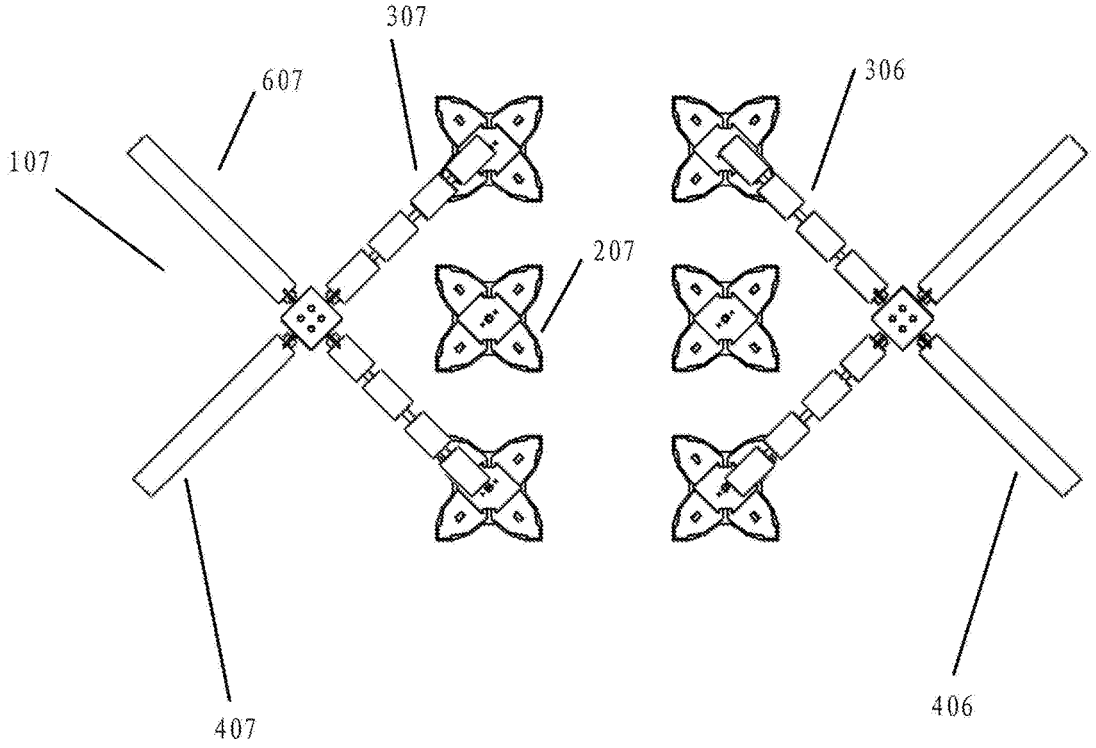
FIG. 10 is a partial top view of a multi-band antenna in accordance with a seventh embodiment of the present invention.

Referring now to FIG. 10, a partial top view of a multi-band antenna in accordance with a seventh embodiment of the present invention is shown. A low-band radiating element 107 has a first dipole arm 307 and a second dipole arm 407. The first dipole arm 307 is positioned close to the high-band radiating elements 207, whereas the second dipole arm 407 is positioned farther away from the high-band radiating elements 207. In the example as is shown, the first dipole arm 307 has four arm segments 607 that are spaced apart from each other and that have substantially the same length. Unlike the first to sixth embodiments of the present invention, the second dipole arm 407 in the seventh embodiment is constructed as a continuous arm segment.

Figure 11:
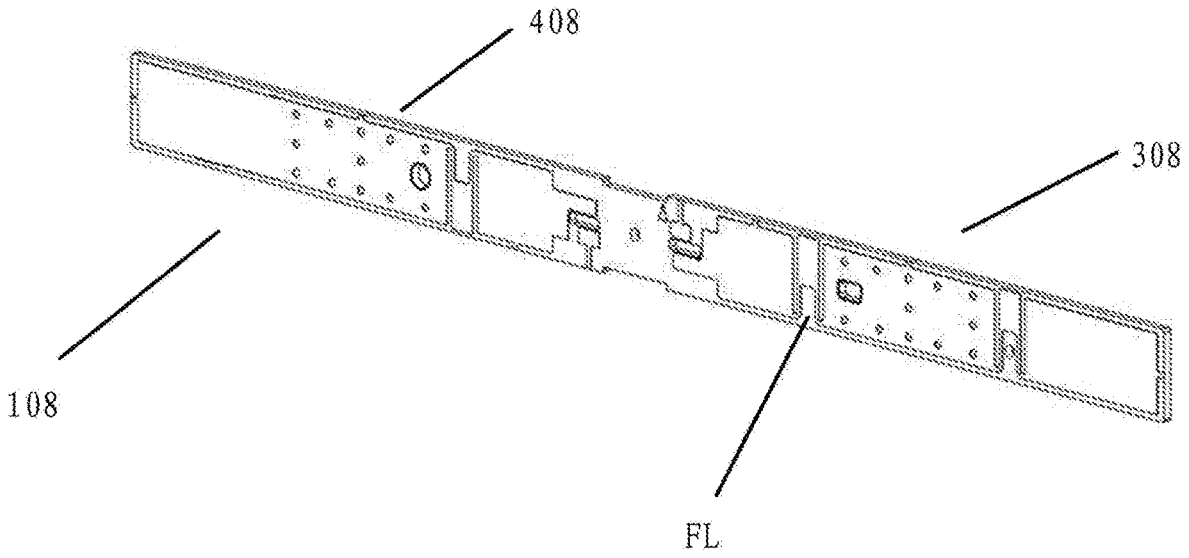
FIG. 11 is a schematic view of a PCB-based low-band radiating element in accordance with the present invention.

Referring now to FIG. 11, a schematic view of a PCB-based low-band radiating element 108 in accordance with the present invention is shown. The low-band radiating element 108 has a first dipole arm 308 and a second dipole arm 408 (although the high-band radiating elements are not shown in FIG. 11, the dipole arm that is positioned close to the high-band radiating element is still referred to as a first dipole arm 308, and the dipole arm that is positioned farther away from the high-band radiating element is referred to as a second dipole arm 408). The first dipole arm 308 is arranged opposite the second dipole arm 408 at an angle of 180 degrees. In the example as is shown, the first dipole arm 308 has three arm segments and the second dipole arm 408 has two arm segments. A filter mechanism (FL) is connected between adjacent arm segments, and said filter mechanism is composed of an inductor and a capacitor. Thus, the first dipole arm 308 has two filter mechanisms FL and the second dipole arm 408 has one filter mechanism FL. As the filter mechanism FL exhibits high impedance characteristics in the high band and low impedance characteristics in the low hand, it can relieve the interference to the high band, and can meanwhile improve the return loss performance. In other examples, the first dipole arm 308 may have more than three or less than three arm segments, and the second dipole arm 408 may have more than two or less than two arm segments, so far as the desired return loss performance and transparency performance are satisfied.

Figure 12:
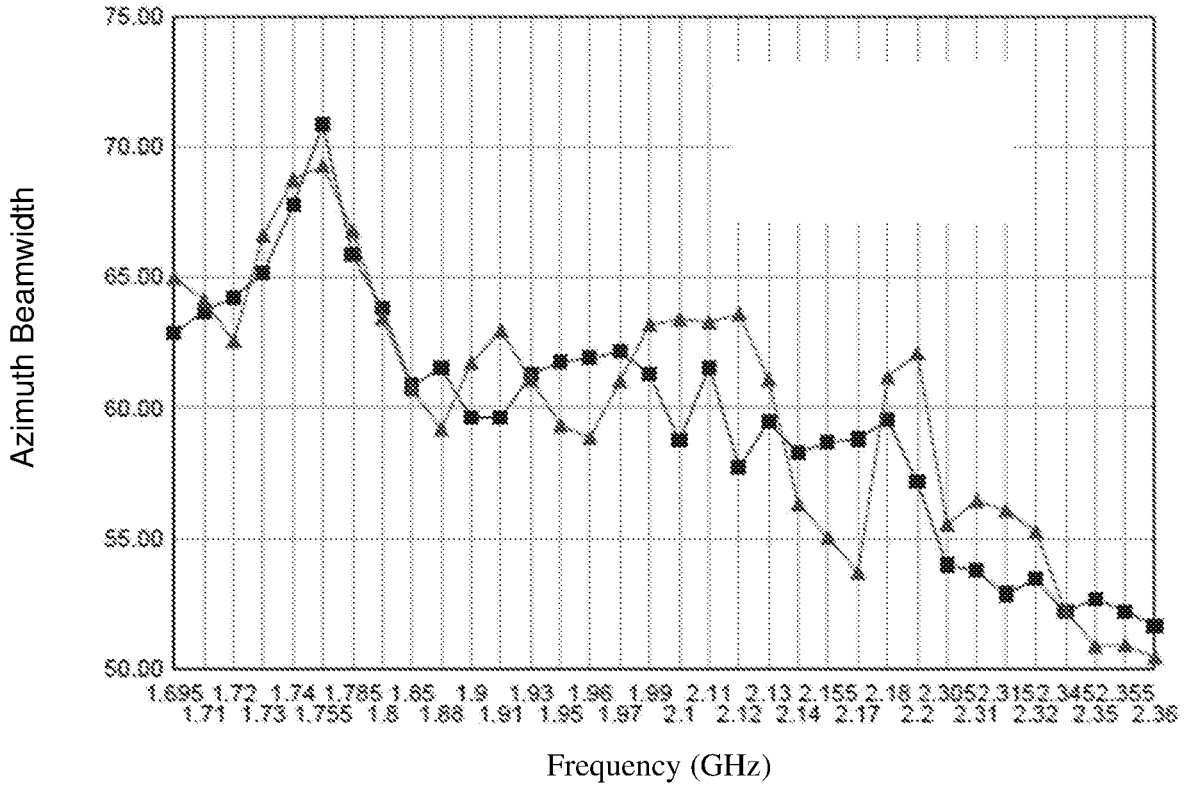
FIG. 12 is a characteristic curve diagram showing the beam width of the second band radiating element of the multi-band antenna in accordance with the present invention and that of the second band radiating element of the prior art multi-band antenna.

Referring now to FIG. 12, which is a characteristic curve diagram showing the beam width of the second band radiating element of the multi-band antenna in accordance with the present invention and that of the second band radiating element of the prior art multi-band antenna. In the diagram, the curve with squares represents the azimuth beam width characteristic curve of the second band radiating element of the prior art multi-band antenna, while the curve with triangles represents the azimuth beam width characteristic curve of the second band radiating element of the multi-band antenna of the present invention. The prior art multi-band antenna has a first band radiating element with "symmetric dipoles", while the multi-band antenna of the present invention has a first band radiating element with "asymmetric dipoles." As can be seen from the diagram, the azimuth beam widths at each frequency are not significantly different in these two instances. Thus, although the second dipole arm of the first band radiating element in the present invention has fewer arm segments, as the second dipole arm is remote from the second band radiating element and the first dipole arm close to the second band radiating element still retains many arm segments (e.g., with the same number as the prior art), the interference of the first band radiating element to the second band radiating element is maintained at a low level. Thus, the azimuth beam width of the second band radiating element of the present invention is not appreciably deteriorated by the "asymmetric dipoles."

Figure 13:
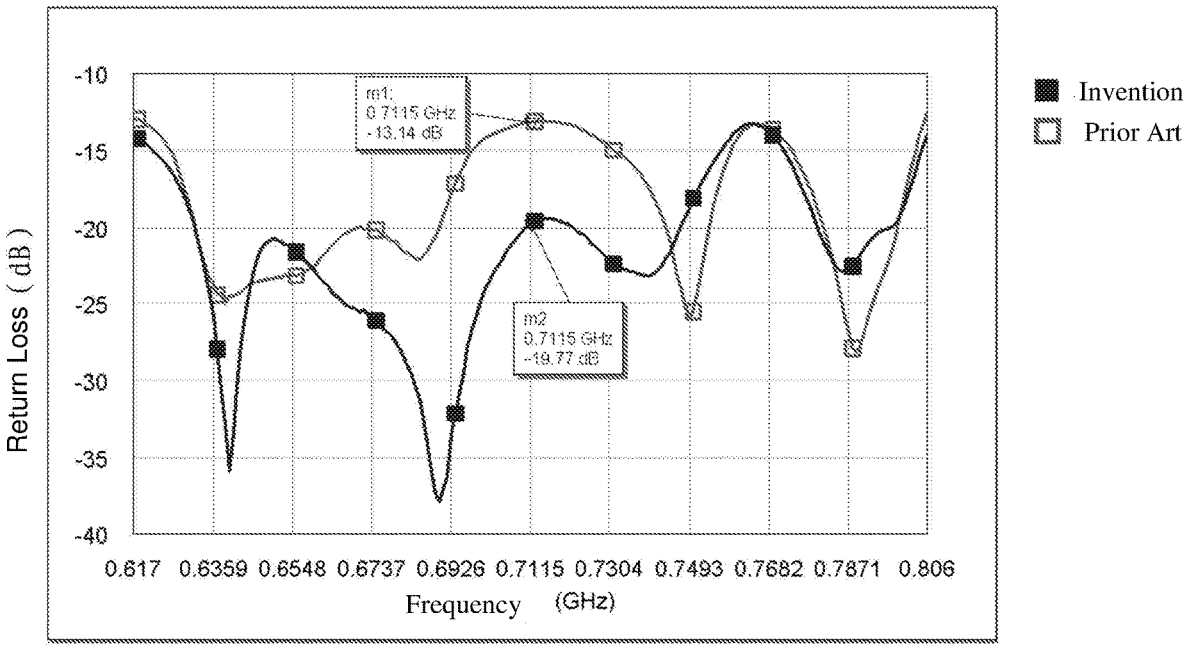
FIG. 13 is a characteristic curve diagram showing the return loss performance of the multi-band antenna in accordance with the present invention and that of the prior art multi-band antenna.

Refer now to FIG. 13, which is a characteristic curve diagram showing the return loss of the multi-band antenna in accordance with the present invention and that of the prior art multi-band antenna. In the diagram, the curve with hollow squares represents the return loss curve for the prior art multi-band antenna, while the curve with solid squares represents the return loss curve of the multi-band antenna of the present invention. The prior art multi-band antenna has a first band radiating element with "symmetric dipoles", while the multi-band antenna of the present invention has a first band radiating element with "asymmetric dipoles." As can be seen from the diagram, the two curves are substantially the same at both ends of the band, i.e. at 0.617 GHz and 0.806 GHz, while in the middle of the band, for example, at between 0.6737 GHz and 0.7304 GHz, the return loss of the radiating element of the present invention is significantly lower than that of the prior art, for example, at 0.7115 GHz, the return loss of the prior art radiating element is −13.14 dB, whereas the return loss of the radiating element of the present invention is −19.77 dB. Thus, it can be seen that the "asymmetric dipoles" of the present invention have a significantly lower return loss. It should be noted that the embodiments of the first band radiating element of the present invention may be adjusted according to the actual operating band, so that the return loss remains at a low level at said operating band.

Although the exemplary embodiments of the present invention have been described, a person skilled in the art should understand that, multiple changes and modifications may be made to the exemplary embodiments without substantively departing from the spirit and scope of the present invention. Accordingly, all the changes and modifications are encompassed within the protection scope of the present invention as defined by the claims. The present invention is defined by the appended claims, and the equivalents of these claims are also contained therein.

That which is claimed is:

1. A first band radiating element for a multi-band antenna, comprising:

at least one first band dipole that has a first dipole arm and a second dipole arm, wherein each of the first and second dipole arms includes one or more arm segments, and wherein a number of arm segments included in the first dipole arm is greater than a number of the arm segments included in the second dipole arm.

2. The first band radiating element according to claim 1, wherein the multi-band antenna further includes a plurality of second band radiating elements that are configured to operate in a different frequency band than the first band radiating element.

3. The first band radiating element according to claim 2, wherein a minimum distance between the second dipole arm and any of the second band radiating elements is greater than a minimum distance between the first dipole arm and any of the second band radiating elements.

4. The first band radiating element according to claim 3, wherein at least one of the second band radiating elements is disposed in a vicinity of a region underneath the first dipole arm and the second band radiating elements are remote from a region underneath the second dipole arm.

5. The first band radiating element according to claim 1, wherein the first dipole arm is positioned opposite the second dipole arm at an angle of 180 degrees.

6. The first band radiating element according to claim 1, wherein the first dipole arm and the second dipole arm each include a central conductor and a plurality of arm segments arranged around the central conductor, wherein the plurality of arm segments are spaced apart from each other along the central conductor.

7. The first band radiating element according to claim 6, wherein at least some of the arm segments comprise a hollow electrical conductor that is connected at one end to the central conductor and disconnected at another end from the central conductor.

8. The first band radiating element according to claim 7, wherein a plurality of protrusions are disposed axially on the central conductor from one end of the central conductor and spaced apart from each other, thereby dividing the central conductor into a plurality of electrically conducting segments, the hollow electrical conductor and the central conductor being connected on the protrusions.

9. The first band radiating element according to claim 8, wherein in the second dipole arm, at least two adjacent protrusions are electrically connected through said hollow electrical conductor.

10. The first band radiating element according to claim 9, wherein the hollow electrical conductor which connects the at least two adjacent protrusions is disposed in an end region or a middle region of the second dipole arm.

11. The first band radiating element according to claim 9, wherein an electrically conducting segment of the plurality of electrically conducting segments between the at least two adjacent protrusions is omitted.

12. The first band radiating element according to claim 7, wherein the hollow electrical conductor is a hollow cylindrical structure.

13. The first band radiating element according to claim 7, wherein gaps are present between the hollow electrical conductor and the central conductor.

14. The first band radiating element according to claim 13, wherein the gaps are filled with air, or the gaps are at least partially filled with dielectric material.

15. The first band radiating element according to claim 2, wherein the first band radiating element is a low-band radiating element and a second band radiating element of the plurality of second band radiating elements is a high-band radiating element.

16. The first band radiating element according to claim 1, wherein the first dipole arm and the second dipole arm are constructed on a common printed circuit board.

17. The first band radiating element according to claim 16, wherein the first dipole arm and the second dipole arm each includes has a plurality of spaced-apart arm segments, with adjacent arm segments being connected via respective filters.

18. The first band radiating element according to claim 17, wherein each filter comprises an inductive element or a combination of the inductive element and a capacitive element.

19. The first band radiating element according to claim 18, wherein each filter exhibits a high impedance characteristic in a second band and a low impedance characteristic in a first band.

20. A multi-band antenna, wherein the multi-band antenna comprises the first band radiating element and a second band radiating element of the plurality of second band radiating elements according to claim 2, and the first band is different from the second band.

* * * * *